US007137508B2

(12) United States Patent
Schultz et al.

(10) Patent No.: US 7,137,508 B2
(45) Date of Patent: Nov. 21, 2006

(54) FOLDING BOX FOR DISPLAYING AN ARTICLE

(75) Inventors: Günther Schultz, Hamburg (DE); Stefan Rüster, Hamburg (DE)

(73) Assignee: Beiersdorf AG, Hamburg (DE)

( * ) Notice: Subject to any disclaimer, the term of this patent is extended or adjusted under 35 U.S.C. 154(b) by 305 days.

(21) Appl. No.: 10/738,393

(22) Filed: Dec. 16, 2003

(65) Prior Publication Data

US 2005/0029160 A1 Feb. 10, 2005

(30) Foreign Application Priority Data

Dec. 16, 2002 (DE) ..... 102 58 586

(51) Int. Cl.
*A45C 11/00* (2006.01)
*B65D 85/14* (2006.01)

(52) U.S. Cl. ..... 206/485; 206/277; 206/780

(58) Field of Classification Search ..... 206/277 X, 206/461–471, 485 X, 779 X, 780, 806, 775
See application file for complete search history.

(56) References Cited

U.S. PATENT DOCUMENTS 3,349,897 A * 10/1967 Stone ..... 206/780
3,493,103 A * 2/1970 Cote ..... 206/418
3,847,282 A * 11/1974 Collura et al. ..... 206/782
3,887,067 A * 6/1975 Collura et al. ..... 206/780
4,300,683 A * 11/1981 Roccaforte ..... 206/485
4,420,077 A * 12/1983 Roccaforte ..... 206/780
5,392,919 A * 2/1995 Passamoni ..... 206/576
6,059,103 A * 5/2000 Izen et al. ..... 206/314
6,298,995 B1 * 10/2001 Schwester ..... 206/779

FOREIGN PATENT DOCUMENTS

DE 299 12 221 U1 10/1999
FR 2 743 051 7/1997

OTHER PUBLICATIONS

European Search Report dated Mar. 19, 2004 from European Application No. EP 03 02 8880.7.
German Search Report dated Jun. 4, 2003 from German Application No. 102 58 586.5.

* cited by examiner

*Primary Examiner*—Jila M. Mohandesi
(74) *Attorney, Agent, or Firm*—Alston & Bird LLP

(57) ABSTRACT

The invention relates to a folding box (1) for displaying and/or packaging an article (90). The folding box comprises a rear wall (2), on which in each case one side wall (3), (4) is articulated laterally, a base flap (5) is articulated at the bottom and a rear flap (6) is articulated at the top. A collar (9) is articulated via the rear flap (6), this collar being located perpendicularly to the rear wall (2) and having a cutout (190), in which the article which is to be packaged can be positioned. The side walls (4) and (3) are positioned such that they can fix the article (90). Above the collar (9), a folding part (11), (10) is articulated on the respective side walls (4) and (3) via a respective scoring formation (111) and (110) such that the fold parts (10, 11) are positioned, if appropriate adhesively bonded, one above the other. The base flap (5) is located perpendicularly to the rear wall (2) and has two insertion noses (14, 15), which are each connected to the inside of the side wall (3), (4).

37 Claims, 4 Drawing Sheets

FOLDING BOX FOR DISPLAYING AN ARTICLE

The invention relates to a manual-assembly folding box for displaying and/or packaging an article. The folding box comprises a rear wall, on which in each case one side wall is articulated laterally, a base flap is articulated at the bottom and a rear flap is articulated at the top. A collar is articulated via the rear flap, this collar being located perpendicularly to the rear wall and having a cutout, in which the article which is to be packaged can be positioned. The side walls are positioned such that they can fix the article. Above the collar, two folding parts are articulated on the side walls via a scoring formation such that the fold parts are positioned one above the other, with or without adhesive bonding. The base flap is located perpendicularly to the rear wall and has two insertion noses, which are each connected to the inside of the side walls.

For displaying, inter alia, articles which are customarily used in the office, sticks of adhesive may be mentioned by way of example, or cosmetics or other articles for everyday use in bottle or canister form, use is often made of straightforward cardboard sleeves, which are enclosed, in part, by a transparent covering made of plastic film or the like.

A further known possibility is for the articles to be fully contained in boxes or cartons, which has the advantage that the articles are protected against dust.

A more modern trend is for the article to be provided with blister packing, that is to say for the article to be displayed beneath transparent, more or less strong plastic packaging which is closed on the rear side, in particular, by a wall made of paperboard or cardboard. Although this packaging may be aesthetically pleasing, it has the disadvantage of being complex and expensive two-material packaging which, for ecological reasons, should be disposed of in separate parts once it has been torn open.

Straightforward blister cards are already in common use. They comprise a single wall, for example made of paperboard or cardboard, on which the product which is to be sold is fastened in various ways. The dimensions of the blister card are generally larger than those of the product, with the result that there is a certain surface area available on the blister card for informing the potential customer about the product or for easily drawing attention to the product by eye-catching printing.

In many cases, the amount of space which is present on the blister card, both on the front wall and on the rear wall of the blister card, is insufficient for accommodating all the information which could be printed thereon.

In such a case, attempts have been made to render the blister card large enough for the necessary amount of space to be provided.

This procedure, however, has a number of disadvantages. In the case of an excessively large blister card only a small number of products can be displayed at the same time in a sales rack. It is also difficult for the customer to accommodate the product with the blister card, once purchased, for example in a shopping bag. The customer would easily be tempted here to separate the blister card immediately from the product, in which case he/she would, in some circumstances, lose important information.

DE 296 06 678 U discloses a blister card which is made up of two walls, preferably made of cardboard or paperboard, specifically a first, front wall, and a second, rear wall, the latter being articulated on the front wall via a folding line and preferably having the same dimensions.

Furthermore, a device for accommodating a product is provided at least on the front wall. This accommodating device is advantageously a non-continuous cage which is open on one side, is preferably made of paperboard and has the open side adhesively bonded to the front wall.

In order that the blister card can be closed, at least one spot of adhesive with lightly self-adhesive and pressure-sensitive properties is provided on the front wall or on the rear wall, to be precise preferably on the edge located opposite the folding line which connects the front wall and the rear wall, it being possible for said adhesive to be detached again, without leaving any residues, from the opposite wall and adhesively bonded to the latter again. This spot or these spots of adhesive allows/allow the swing-open blister card to be repeatedly opened and firmly closed.

A further disadvantage of known blister packs is that they must not be used for packaging aerosol containers as are often used, for example, in cosmetics or for wound treatment.

It is likewise the case that the product which is to be displayed cannot suitably be stored in a stable manner by the known blister packs. Conventional blister packs cannot be stood upright in sales racks.

It is thus an object of the invention to provide a folding box which can display an article in a secure and aesthetically pleasing manner, the article being fixed securely in the packaging in order likewise to comply with safety aspects. It is a further object of the present invention to provide packaging which has a large amount of surface area for additional product information, in which there is no need to use a number of materials for production purposes, which, with as little material as possible being used, has a high level of stability and can be produced cost-effectively, and of which the folding blank comprises a single piece and can be assembled in a minimal amount of time. It is also the object of the present invention to provide a stable folding box.

This object on which the invention is based is achieved by the teaching of the main claim. Advantageous configurations are explained in the subclaims. The invention also covers a punched blank of the folding box according to the invention.

Accordingly, the invention relates to a folding box for displaying or packaging an article, the folding box comprising a rear wall, on which in each case one side wall is articulated laterally, a base flap is articulated at the bottom and a rear flap is articulated at the top. The rear flap is adhesively bonded to the inside of the rear wall and connected to a collar via a folding line, this collar being located perpendicularly to the rear wall and having a cutout, in which the article to be packaged can be positioned. The side walls are positioned on the vertical collar such that they additionally fix the article. Above the collar, folding parts are articulated on the side walls via an arcuate scoring formation such that the fold parts, positioned one above the other, are fixed by the product or adhesively bonded. The base flap is located perpendicularly to the rear wall and has two insertion noses, which are each connected to the inside of the side wall.

It was unexpected, and a complete surprise to the person skilled in the art, that the series of objects is achieved by the folding box according to the invention.

The folding box according to the invention is suitable for the manual packaging of everyday articles such as those used in the office, cosmetics or wound-treatment means. In particular, aerosol containers in the form of canisters or bottles can be reliably handled using the present folding box. The vertically articulated base flap even ensures extremely good stability on a shelf. Moreover, the base prevents the article from simply slipping out of the packaging.

The folding-box blank may be supplied in a state in which it has already been adhesively bonded at the factory. In this case, the rear flap is adhesively bonded to the rear wall and the collar is folded upward.

If the preliminary adhesive bonding is only carried out during assembly, in the first instance, the rear flap is adhesively bonded to the rear wall and the collar is folded upward. The folding parts are positioned and adhesively bonded one above the other. The left-hand side wall of the folding box is inflected via the folding line and the right-hand side wall is then folded forward via the folding line, the collar being located perpendicularly to the rear wall. The product is then introduced from beneath through the cutout in the collar. The top part of the product, which projects out of the collar, butts against the folding parts and fixes the same. Finally, the base flap is swung up and the insertion noses are connected, preferably adhesively bonded, to the inside of the side walls.

The swung-over side walls fix the product from the side, the base gives the product stability, and the collar avoids the situation where the product falls over, with the result that the product is provided with all-round wrapping without being completely concealed.

In contrast to a blister card, the folding box according to the invention has a basic structure and acts like a stable folding box without being closed. Furthermore, the side walls, the folding parts or, if appropriate, the rear wall give a large amount of design-related surface area. It is particularly important, however, for the product itself, or at least the central part of the front side of the product, to be completely visible and for unsightly text which has to be included to remain concealed on the rear side of the product.

According to the invention, the fold parts, the base flap and the collar cutout are shaped in accordance with the product which is to be packaged.

The folding parts are preferably shaped in the same way and the article is embedded on the folding parts.

Accordingly, the scoring formation may be shaped in an arcuate or rectilinear manner in order to provide the folding parts with an abutment shape which is adapted to the article. For example, an arcuate scoring formation provides a uniformly pleasing configuration of the abutment surface. If appropriate, furthermore, at least one of the folding parts has a cutout which is adapted to the shape of the article and is intended for accommodating the article in a form-fitting manner.

The cutout in the collar, in accordance with the shape of the article which is to be packaged, may be round, polygonal or oval or adapted precisely to the outlines of the article.

The width of the side walls is preferably selected such that they surround the article laterally with the edge. Depending on the width and product diameter, the side walls are positioned at an angle of less than 90° in relation to the rear wall. It is thus possible, depending on the shape or nature of the product or the printing, for the product to be fixed centrally or in the bottom or top regions.

Forming the side-wall edges with round, rectilinear or any desired contours allows adaptation to any desired article shapes.

It is likewise possible for the shape of the base flap to be adapted to the base of the article or the shape of the latter in plan view, and it should advantageously correspond to the same.

By virtue of an additional hanging device with a so-called standard European-hole hanging means, as is described for example in DE 195 35 008, which is provided in the rear wall, the product can be hung on a sales hook using the hanging means. A hanging device of this type or just one cutout is thus provided in the rear flap and/or the folding parts.

According to the invention, the term "article" which is used here must not be so narrow as to make it necessary for the article to comprise a single part. Rather, the article or the item may be constructed from a plurality of individual components. It is also possible for two or more products to be arranged simultaneously within one wrapper, these products then forming an article made up of a plurality of individual bodies.

In a further advantageous embodiment, a further collar with a corresponding cutout is articulated in a mirror-inverted manner on the collar, the two being adhesively bonded to one another. In addition, a flap is also advantageously articulated on the further collar and is adhesively bonded to the inside of the rear wall. This embodiment provides a stable, double-layered collar which is fastened to the rear wall via the additional flap.

In order to stabilize the collar further, the side walls have notches, in which the vertical collar engages. It is thus the case that the collar and the side walls are not just positioned one on the other, but engage in a form-fitting manner one inside the other via the notch, which also results in the product being stabilized.

The position of the collar is also critical for fastening the product. The collar may be arranged, for example, in the center in order that the center of gravity of the product is aligned with the means of hanging it on the sales hook. The position of the collar is determined via the length of the rear flap. A centrally arranged collar means that the rear flap is half the length of the rear wall. The length of the rear flap is thus in the range from 0.9 to 0.1, preferably 0.33 to 0.5, of the length of the rear wall.

If the product is, for example, an elongate one which, in addition, requires more support in the top region, then the length of the rear flap is relatively short, with the result that the collar engages around the product in the top region.

A further preferred embodiment has, at least on one of the side walls, and preferably on both side walls, side parts which, swung inward, are adhesively bonded to the side wall so as to produce slots between the side wall and the side parts, in which the insertion noses of the base flap can engage and thus ensure the interconnection with the side wall or walls. Adhesive bonding of the base is thus not necessary and it is possible for the customer to remove the product easily without destroying the folding box. The customer releases the insertion noses from the slots, swings the base over and can thus remove the product from the collar in the downward direction and, if appropriate, repackage it securely in the reverse order.

The folding box thus has a large number of advantages.

The packaging accommodates at least one article.

A further advantage can be seen in that the article can be displayed to very good effect in the folding box, but is reliably protected by the collar, the side walls and the base.

A further advantage of this packaging is that the individual article, for example a cosmetics bottle or wound spray, can be effectively advertised as a give-away product.

This type of packaging achieves a cost-effective and nevertheless eye-catching display which is highly effective in getting the standard product recognized.

Front sides and the rear side of the folding box provide outstanding design possibilities. The folding box, furthermore, is environmentally friendly and is produced from a single folding blank.

A particularly advantageous configuration of the folding box together with a punched blank is explained in more detail with reference to the figures described below, without this being intended to limit the invention unnecessarily in any way. In the figures:

FIG. 1 illustrates the punched blank of the folding box. The punched blank may consist of cardboard, paperboard or some other suitable material.

Figure 1:
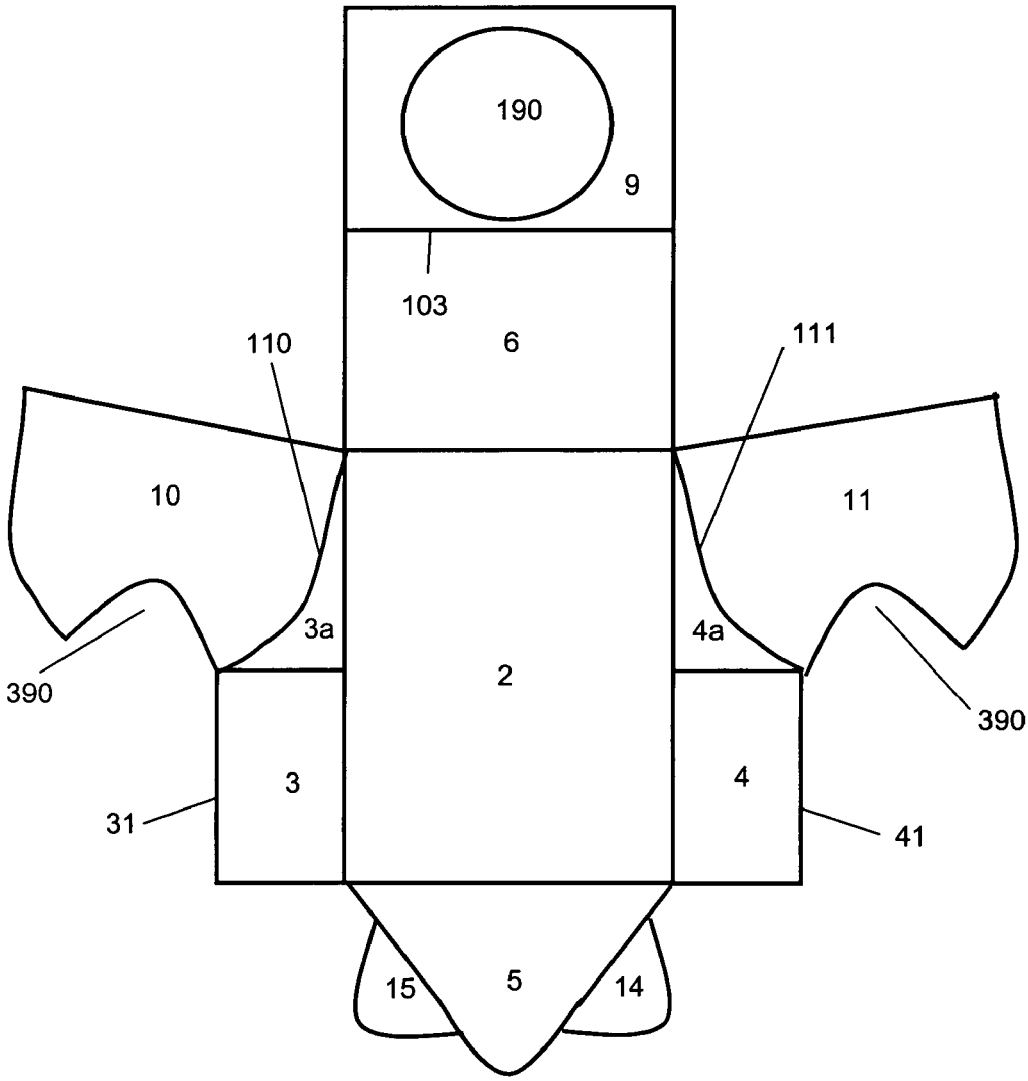
FIG. 1 shows a punched blank of the folding box according to the invention

On the rear wall (2), the side wall (3), (4) is articulated laterally, a base flap (5) is articulated at the bottom and a rear flap (6) is articulated at the top. A collar (9) is articulated on the rear flap (6) via a folding line (103), this collar having a cutout (190), in which the article which is to be packaged can be positioned.

It is possible for the cutout to be continuous, i.e. of annular configuration, or to have a gap.

In the top region (3*a*, 4*a*), folding parts (11) and (10) are articulated on the side walls (3, 4) via a scoring formation (111), (110), the top region (3*a*, 4*a*) corresponding to the length of the rear flap (6).

The top region (3*a*, 4*a*) is determined by similar dimensions corresponding to the length of the rear flap (6) and the folding parts (10, 11), which are articulated on the side walls (3, 4). The vertical collar (9) likewise serves as a boundary of the top region, which is indicated by (3*a*, 4*a*) in the drawings.

Two insertion noses (14, 15) are articulated on the base flap (5) and, with the folding box in the assembled state, are fastened on the inside of the side walls (3, 4).

The fold parts (10) and (11) are preferably shaped in the same way and at least one of the fold parts (10, 11) has, preferably both of them have, a cutout (390) for accommodating the article (90) in a form-fitting manner.

Figure 2:
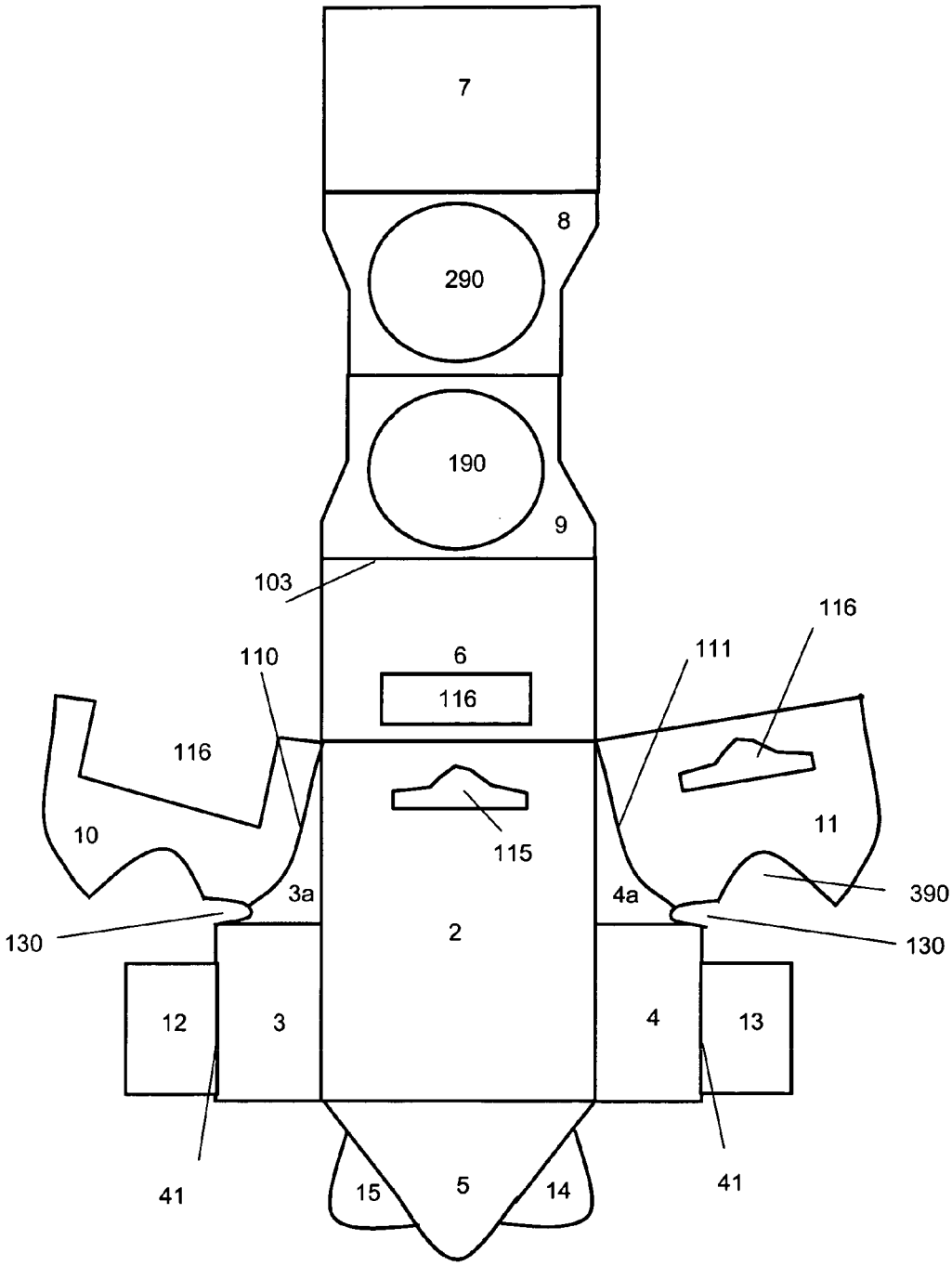
FIG. 2 shows a preferred embodiment of the punched blank of the folding box according to the invention.

FIG. 2 illustrates a preferred form of the punched blank corresponding to FIG. 1. In addition to the surface areas which are present in FIG. 1, the preferred punched blank according to FIG. 2 has a mirror-inverted collar (8) with a corresponding cutout (290) which is articulated at the top of the collar (9). The two cutouts (190, 290) are preferably of the same shape and, with the folding box in the assembled state, are positioned congruently one above the other. A further flap (7) is articulated at the top of the collar (8). Side parts (12) and/or (13) are articulated on at least one of the side walls (3) and/or (4) and, with the folding box in the assembled state, have been swung over inward and adhesively bonded to the side walls.

The side walls (3) and (4) have notches (130) level with the starting point of the top region (3*a*, 4*a*), i.e. at the location at which the collar (9) is erected. The notches (130) are designed such that the single-layered collar (9) or the double-layered collar (8, 9) can be fitted in in a form-fitting manner.

A hanging device (115), if appropriate with a slot or round hole, is preferably provided in the top region of the rear wall (2). Accordingly, a cutout or a similar type of hanging device (116) is provided in the rear flap (6) and, if appropriate, in the fold parts (10) and/or (11). In the extreme case, a four-layered hanging device (115, 116) is achieved by virtue of the rear flap (6) being adhesively bonded to the rear wall (2) and the fold parts (10, 11) being positioned one above the other. The fold part (10) and the rear flap (6) thus preferably have just amorphous cutouts.

Figure 3:
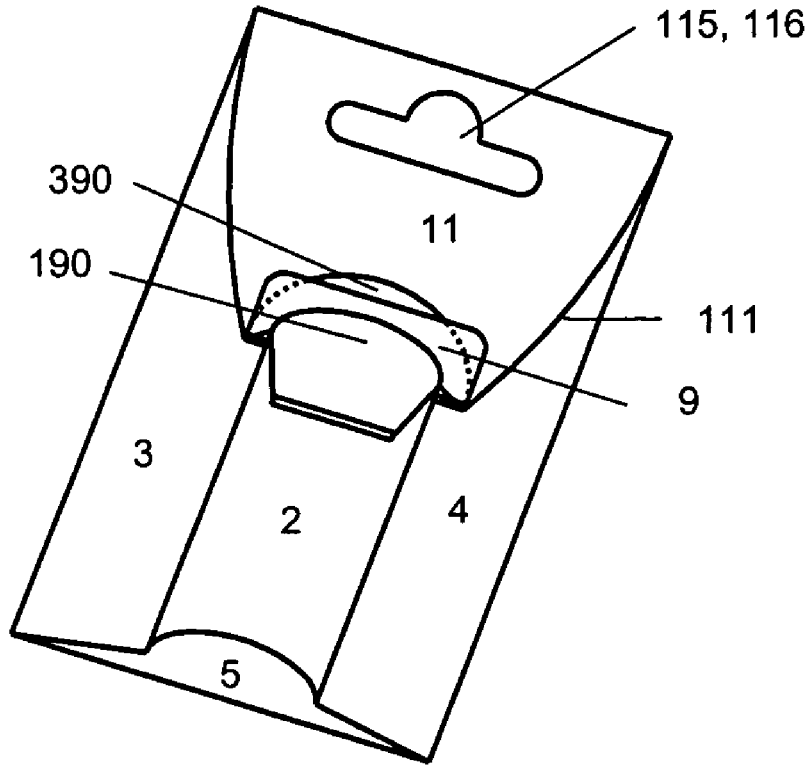
FIG. 3 shows a plan view of the folding box without any article which is to be packaged.

FIG. 3 shows the plan view of a finished folding box. The two side walls (3, 4) have been swung upward approximately at an angle of 45° and the base (5) is fastened on the side walls via the insertion noses (14, 15), which are not visible.

Figure 4:
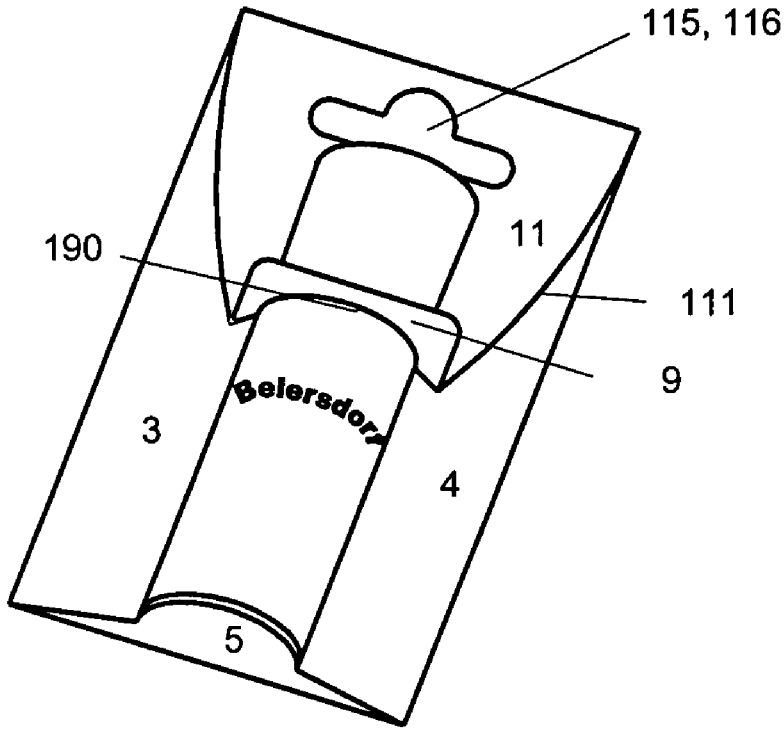
FIG. 4 shows a plan view of the folding box with the article which is to be packaged.

The collar cutouts (190) and (290) are round, in accordance with a, for example, round product. The size of the cutouts is adapted logically to the product dimensions. FIG. 4 shows, for example, a finished folding box in which a round article, a spray bottle, is positioned.

As is explained in FIGS. 2 and 4, the scoring formation (110), (111) is preferably configured in an arcuate manner, with the result that, when assembled with an article, the folding box adapts uniformly to the shape of the article.

The operation of assembling the folding box with product takes a minimal amount of time. In the first instance, the left-hand side wall (3) is folded forward together with the top folding part (10). In this case, the notch (130) is fitted in a form-fitting manner onto the double-layered collar (8, 9). The same is then done with the right-hand side wall (4) and the top folding part (11).

The article is pushed in from beneath through the cutouts (190, 290) of the collar (8, 9) and the base (5) is inserted, by way of its insertion noses (14, 15), into the slot formed from side walls (3, 4) and the articulated side parts (12, 13).

The invention claimed is:

1. A folding box for displaying and/or packaging an article, comprising:

a rear wall having a top edge, a bottom edge opposite said top edge, a first side edge, and a second side edge opposite said first side edge;

a base flap articulated on said rear wall along said bottom edge and oriented perpendicular to said rear wall;

a rear flap articulated on said rear wall along said top edge and adhesively bonded to said rear wall;

a first collar connected to said rear flap via a folding line, said collar oriented perpendicular to said rear wall and having a cutout into which said article can be positioned;

a first side wall articulated on said rear wall along said first side edge;

a second side wall articulated on said rear wall along said second side edge, said side walls being positioned on the collar such that they orient said article;

a first folding part articulated on said first side wall via a scoring formation;

a second folding part articulated on said second side wall via a scoring formation, said folding parts being positioned one above the other, and two insertion noses articulated on the base flap and connected respectively to said first side wall and said second side wall.

2. The folding box as claimed in claim 1, wherein said first folding part is adhesively bonded to said second folding part.

3. The folding box as claimed in claim 1, wherein a second collar with a cutout corresponding to the cutout of said first collar is articulated in a mirror-inverted manner on the first collar.

4. The folding box as claimed in claim 3, wherein said second collar is adhesively bonded to said first collar.

5. The folding box as claimed in claim 3, wherein a flap is articulated on the second collar and adhesively bonded to said rear wall.

6. The folding box as claimed in claim 1, wherein a first side part is articulated on said first side wall and a second side part is articulated on said second side wall thereby producing slots for engaging said two insertion noses and ensuring interconnection with said first side wall and said second side wall.

7. The folding box as claimed in claim 6, wherein said first side part is adhesively bonded to said first side wall and said second side part is adhesively bonded to said second side wall.

8. The folding box as claimed in claim 1, wherein said first side wall and said second side wall each have notches for engaging said first collar.

9. The folding box as claimed in claim 1, wherein said first folding part and said second folding part are shaped in the same way and the article is embedded on said first folding part and said second folding part.

10. The folding box as claimed in claim 9, wherein at least one of said first folding part and said second folding part has a cutout for accommodating the article in a form-fitting manner.

11. The folding box as claimed in claim 1, wherein a hanging device is provided in a top region of said rear wall adjacent said top edge and a cutout or a hanging device is provided in said rear flap.

12. The folding box as claimed in claim 11, wherein a hanging device or cutout is provided in at least one of said first folding part and said second folding part.

13. The folding box as claimed in claim 1, wherein the length of the rear flap is in from 0.1 to 0.9 the length of the rear wail from said bottom edge to said top edge.

14. The folding box as claimed in claim 1, wherein the length of the rear flap is in from 0.33 to 0.5 the length of the rear wall from said bottom edge to said top edge.

15. The folding box as claimed in claim 1, wherein the cutout in said first collar is round, polygonal, oval or adapted to the outlines of the article.

16. The folding box as claimed in claim 1, wherein the widths of said first side wall and said second side wall are selected such that the first side wall and the second side wall laterally surround the article.

17. The folding box as claimed in claim 1, wherein the scoring formation of said first folding part and said second folding part is arcuate or rectilinear thereby providing the first and second folding parts with an abutment shape that is adapted to the article.

18. The folding box as claimed in claim 1, wherein said first side wall and said second side wall have outer edges opposite the side edges of said rear wall and said outer edges are round, rectilinear or shaped to correspond to the contour of the article.

19. The folding box as claimed in claim 1, wherein the shape of the base flap corresponds to the base of the article or the shape of the article in plan view.

20. A folding-box blank for producing a folding box., comprising a rear wall having a top edge, a bottom edge opposite said top edge, a first side edge, and a second side edge opposite said first side edge;

a base flap articulated on said rear wall along said bottom edge;

a rear flap articulated on said rear wall along said top edge;

a first collar connected to said rear flap via a folding line opposite said top edge and having a cutout therein;

a first side wall articulated on said rear wall along the first side edge of said rear wall;

a second side wall articulated on said rear wall along the second side edge of said rear wall;

opposing folding parts articulated respectively on said first side wall and said second side wall via a scoring formation; and two insertion noses articulated on the base flap.

21. The folding box blank as claimed in claim 20, wherein said opposing folding parts are articulated respectively on a top region of said first side wall and a top region of said second side wall.

22. The folding box blank as claimed in claim 21, wherein the length of the top regions along the side edges of said rear wall corresponds to the length of the side edges of said rear flap.

23. The folding box blank as claimed in claim 20, wherein a second collar with a cutout corresponding to the cutout of said first collar is articulated in a mirror-inverted manner on the first collar.

24. The folding box blank as claimed in claim 23, wherein a flap is articulated on the second collar.

25. The folding box blank as claimed in claim 20, wherein a first side part is articulated on said first side wall and a second side part is articulated on said second side wall thereby producing slots for engaging said two insertion noses and ensuring interconnection with said first side wall and said second side wall.

26. The folding box blank as claimed in claim 20, wherein said first side wall and said second side wall each have notches for engaging said first collar.

27. The folding box blank as claimed in claim 20, wherein said first folding part and said second folding part are shaped for receiving an article.

28. The folding box blank as claimed in claim 27, wherein at least one of said first folding part and said second folding part has a cutout for accommodating an article in a form-fitting manner.

29. The folding box blank as claimed in claim 20, wherein a hanging device is provided in a top region of said rear wall adjacent said top edge and a cutout or a hanging device is provided in said rear flap.

30. The folding box blank as claimed in claim 29, wherein a hanging device or cutout is provided in at least one of said first folding part and said second folding part.

31. The folding box blank as claimed in claim 20, wherein the length of the rear flap is in from 0.1 to 0.9 the length of the rear wall from said bottom edge to said top edge.

32. The folding box blank as claimed in claim 20, wherein the length of the rear flap is in from 0.33 to 0.5 the length of the rear wall from said bottom edge to said top edge.

33. The folding box blank as claimed in claim 20, wherein the cutout in said first collar is round, polygonal, oval or adapted to the outlines of the article.

34. The folding box blank as claimed in claim 20, wherein the widths of said first side wall and said second side wall are selected such that the first side wall and the second side wall laterally surround an article.

35. The folding box blank as claimed in claim 20, wherein the scoring formation of said first folding part and said second folding pan is arcuate or rectilinear thereby providing the first and second folding parts with an abutment shape that is adapted to an article.

36. The folding box blank as claimed in claim 20, wherein said first side wall and said second side wall have outer edges opposite the side edges of said rear wall and said outer edges are round, rectilinear or shaped to correspond to the contour of an article.

37. The folding box blank as claimed in claim 20, wherein the shape of the base flap corresponds to the base of an article or the shape of an article in plan view.

* * * * *